US007982382B2

(12) United States Patent
Liu et al.

(10) Patent No.: US 7,982,382 B2
(45) Date of Patent: Jul. 19, 2011

(54) THERMIONIC ELECTRON SOURCE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 201 days.

(21) Appl. No.: 12/288,862

(22) Filed: Oct. 23, 2008

(65) Prior Publication Data

US 2009/0153012 A1 Jun. 18, 2009

(30) Foreign Application Priority Data

Dec. 14, 2007 (CN) ..... 2007 1 0125114

(51) Int. Cl.
*H01J 63/04* (2006.01)

(52) U.S. Cl. ..... 313/310; 313/495

(58) Field of Classification Search ..... 313/495–497, 313/310

See application file for complete search history.

(56) References Cited

U.S. PATENT DOCUMENTS

| | | | | |
|---|---|---|---|---|
| 1,854,970 | A * | 4/1932 | Agte | 313/311 |
| 5,905,335 | A | 5/1999 | Fushimi et al. | |
| 6,843,696 | B2 | 1/2005 | Kitamura et al. | |
| 6,949,877 | B2 * | 9/2005 | Sun et al. | 313/491 |
| 6,979,244 | B2 * | 12/2005 | Den et al. | 445/24 |
| 7,034,449 | B2 | 4/2006 | Suzuki et al. | |
| 2003/0160570 | A1 | 8/2003 | Sasaki et al. | |
| 2004/0051432 | A1 * | 3/2004 | Jiang et al. | 313/311 |
| 2006/0208620 | A1 | 9/2006 | Muneyoshi et al. | |
| 2007/0024545 | A1 * | 2/2007 | Cho et al. | 345/76 |
| 2009/0167136 | A1 | 7/2009 | Liu et al. | |

FOREIGN PATENT DOCUMENTS

| | | | |
|---|---|---|---|
| CN | 1440044 | A | 9/2003 |
| CN | 1773664 | A | 5/2006 |
| CN | 101471211 | A | 7/2009 |

OTHER PUBLICATIONS

Cox et al., Thermionic emission from defective carbon nanotubes, Applied Physics Letters, Sep. 13, 2004, 2065-2067, vol. 85, No. 11.

* cited by examiner

*Primary Examiner* — Toan Ton
*Assistant Examiner* — Hana S Featherly
(74) *Attorney, Agent, or Firm* — D. Austin Bonderer

(57) ABSTRACT

A thermionic electron source includes a substrate, at least two electrodes, and a thermionic emitter. The electrodes are electrically connected to the thermionic emitter. The thermionic emitter has a film structure. Wherein there a space is defined between the thermionic emitter and the substrate.

14 Claims, 7 Drawing Sheets

THERMIONIC ELECTRON SOURCE

RELATED APPLICATIONS

This application is related to commonly-assigned applications: U.S. patent application Ser. No. 12/288,861, entitled, "METHOD FOR MAKING THERMIONIC ELECTRON SOURCE", filed Oct., 23, 2008; U.S. patent application Ser. No. 12/288,865, entitled "THERMIONIC ELECTRON SOURCE", filed Oct., 23, 2008; U.S. patent application Ser. No. 12/288,996, entitled "THERMIONIC EMISSION DEVICE", filed Oct., 23, 2008; U.S. patent application Ser. No. 12/288,863, entitled "THERMIONIC EMISSION DEVICE", filed Oct., 23, 2008, which is now patented as U.S. Pat. No. 7,772,755; and U.S. patent application Ser. No. 12/288,864, entitled "THERMIONIC ELECTRON EMISSION DEVICE AND METHOD FOR MAKING THE SAME", filed Oct., 23, 2008.

BACKGROUND

1. Field of the Invention

The present invention relates to a thermionic electron source adopting carbon nanotubes.

2. Discussion of Related Art

Carbon nanotubes (CNT) are a carbonaceous material and have received much interest since the early 1990s. Carbon nanotubes have interesting and potentially useful electrical and mechanical properties. Due to these and other properties, CNTs have become a significant contributor to the research and development of electron emitting devices, sensors, and transistors, among other devices.

Generally, an electron-emitting device has an electron source using a thermal or cold electron source. The thermal electron source is used by heating an emitter for increasing the kinetic energy of the electrons in the emitter. When the kinetic energy of the electrons therein is large enough, the electrons will emit or escape from the emitters. These electrons emitted from the emitters are thermions. The emitters emitting the thermions are named thermionic emitters.

Conventionally, the thermionic electron source includes a thermionic emitter and two electrodes. The two electrodes are located on a substrate. The thermionic emitter is located between two electrodes and electrically connected thereto. The thermionic emitter is generally made of a metal wire such as tungsten etc, boride or alkaline earth metal carbonate. When a thermionic electron source uses boride as its thermionic emitter, the substrate will transfer heat from the thermionic emitter to the atmosphere in the process of heating since the thermionic emitter is connected to the substrate. Thus, the thermions emitting property of the thermionic electron source will be affected. Furthermore, since the thermionic emitter adopting the boride or alkaline earth metal carbonate has high resistivity, the thermionic electron source using the same has greater power consumption and is therefore not suitable for applications involving high current density and brightness. What is more, the traditional thermionic emitter materials usually have the typical dimension of about 10 micron to centimeter. They are difficult to be made into the tiny scale for the precise device, especially the device arrays for the special function such as display etc.

What is needed, therefore, is a thermionic electron source with excellent thermal electron emitting properties and wearability, and can be used in flat panel displays with high current density and brightness, logic circuits, and other fields of thermal electron source.

SUMMARY

In one embodiment, a thermionic electron source includes a substrate, at least two electrodes, and a thermionic emitter. The electrodes are electrically connected to the thermionic emitter. The thermionic emitter has a film structure. Wherein there a space is defined between the thermionic emitter and the substrate.

Other novel features and advantages of the present thermionic electron source will become more apparent from the following detailed description of exemplary embodiments when taken in conjunction with the accompanying drawings.

BRIEF DESCRIPTION OF THE DRAWINGS

Many aspects of the present thermionic electron source can be better understood with references to the following drawings. The components in the drawings are not necessarily drawn to scale, the emphasis instead being placed upon clearly illustrating the principles of the present thermionic electron source.

Figure 1:
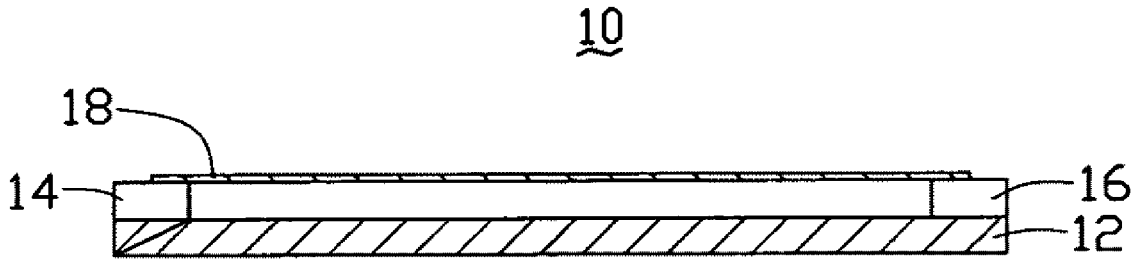
FIG. 1 is an exploded, isometric view of a thermionic electron source in accordance with a first embodiment.

Corresponding reference characters indicate corresponding parts throughout the views. The exemplifications set out herein illustrate at least one exemplary embodiment of the present thermionic electron source, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present thermionic electron source.

Referring to FIG. 1, a thermionic electron source 10, in accordance with a first embodiment, includes a substrate 12, a first electrode 14, a second electrode 16, and a thermionic emitter 18. The first electrode 14 and second electrode 16 are separately located on a surface of the substrate 12. The thermionic emitter 18 is located between the first electrode 14 and second electrode 16 and electrically connected thereto. The thermionic emitter 18 is suspended above the substrate 12 by the first electrode 14 and second electrode 16. The thermionic emitter 18 has a film structure.

The thermionic electron source 10 further includes a low-work-function layer (not shown) located on a surface of the thermionic emitter 18. The low-work-function layer is made of any material capable of inducing the emissions of electrons from the thermionic electron source 10 at a low temperature, such as thorium oxide or barium oxide. Electrons in the low-work-function layer have a lower work function than that in the thermionic emitter 18, and can escape from the low-work-function layer at a lower temperature. Thus, the low-work-function layer can be used to induce emissions of electrons from the thermionic electron source 10 at a lower temperature.

The substrate 12 can be made of ceramics, glass, resins, or quartz, among other materials. A size and shape of the substrate 12 can be set as desired. In the present embodiment, the substrate 12 is a glass substrate.

The first electrode 14 and second electrode 16 are separated in order to prevent a short circuit, wherein a voltage is applied therebetween. The first electrode 14 and second electrode 16 are made of a material selected from a group consisting of conductive metals, graphite, carbon nanotubes, or any other conductive material. The conductive metals can be gold, silver, or copper. When the first electrode 14 and second electrode 16 are layer-shaped, such as a metal coating, a metal foil, or a graphite layer, the first electrode 14 and second electrode 16 are adhesively fixed on the surface of the substrate 12. Specifically, when the first electrode 14 and second electrode 16 contain inherently adhesive carbon nanotube film or carbon nanotube string, the first electrode 14 and second electrode 16 are directly adhered on the substrate 12 by the properties of the electrodes. The method for fixing the first electrode 14 and second electrode 16 on the substrate 12 is not limited to the above-described methods. In the present embodiment, the first electrode 14 and second electrode 16 are a copper layer, and the first electrode 14 and second electrode 16 are adhesively fixed on the substrate 12.

Figure 2:
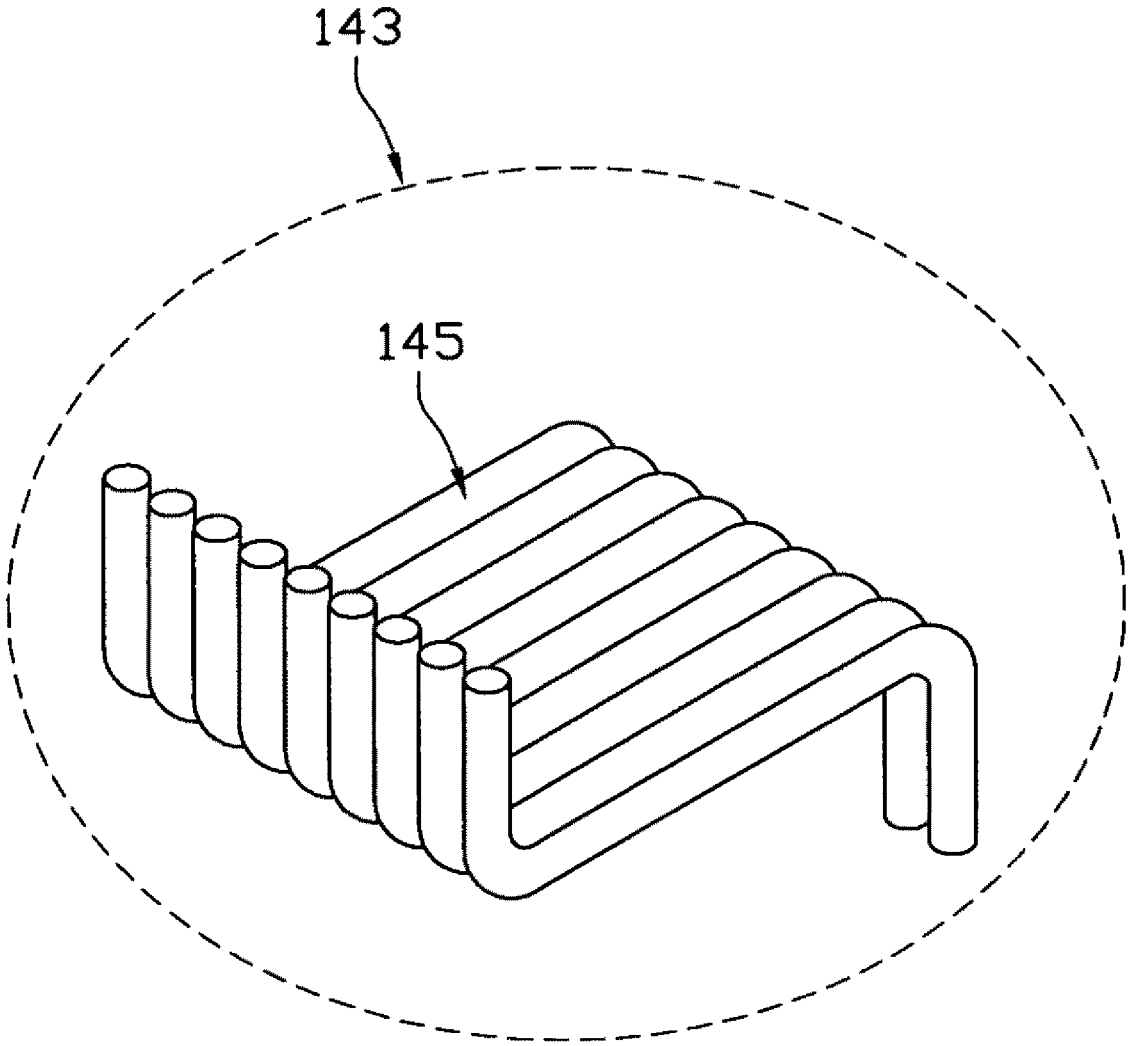
FIG. 2 is a structural schematic of a carbon nanotube segment.
Figure 3:
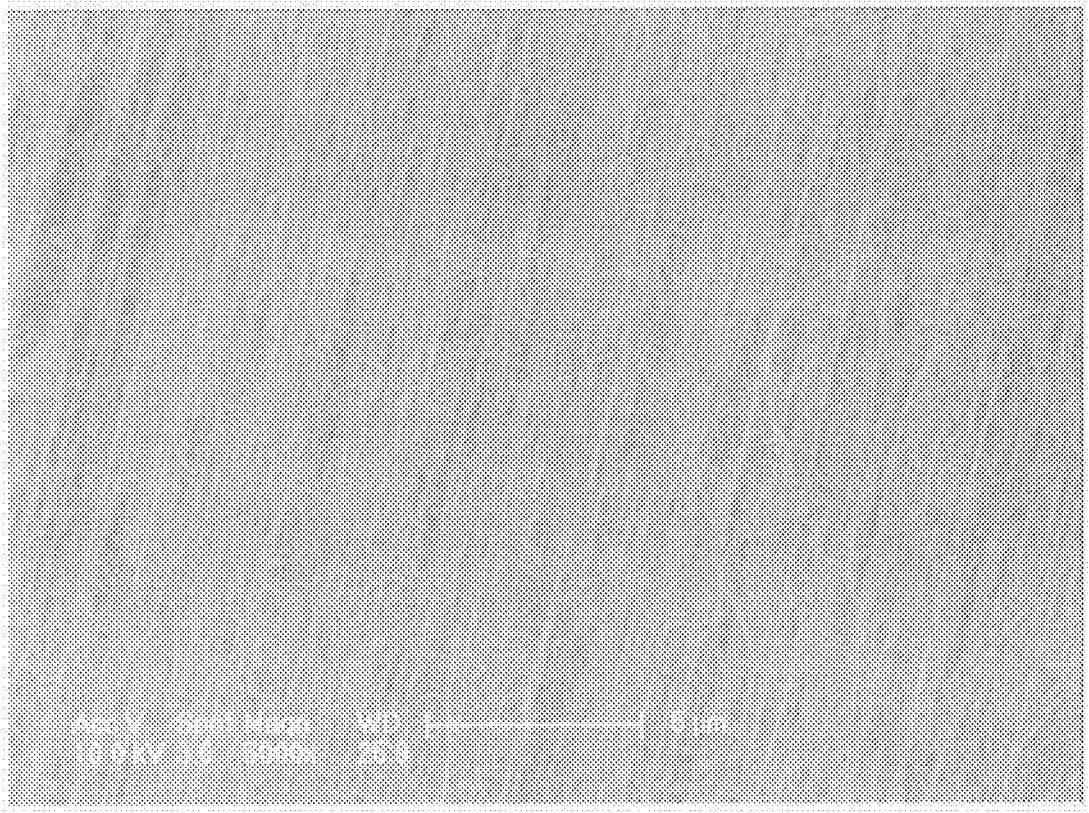
FIG. 3 shows a Scanning Electron Microscope (SEM) image of a carbon nanotube film.

The thermionic emitter 18 is made of borides, oxides, metals or carbon nanotubes. A length of the thermionic emitter 18 approximately ranges from 50 micrometers to 1 millimeter. A width of the thermionic emitter 18 approximately ranges from 50 to 500 micrometers. In the present embodiment, the thermionic emitter 18 includes a carbon nanotube layer. The carbon nantoube layer includes at least one carbon nanotube film. Referring to FIGS. 2 and 3, each carbon nanotube film comprises a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. The carbon nanotube segments 143 can vary in width, thickness, uniformity and shape. The carbon nanotubes 145 in the carbon nanotube film 143 are also oriented along a preferred orientation. In other embodiments, the carbon nantoube layer includes at least two carbon nanotube films. The films are situated such that a preferred orientation of the carbon nanotubes 145 is set at an angle with respect to each other. The angle approximately ranges from 0° to 90°.

In the present embodiment, the carbon nanotube film is acquired by pulling from a carbon nanotube array grown on a 4-inch base. A width of the acquired carbon nanotube film approximately ranges from 0.01 to 10 centimeters. A thickness of the acquired carbon nanotube film approximately ranges from 10 nanometers to 100 micrometers. Furthermore, the carbon nanotube film can be cut into smaller predetermined sizes and shapes. The carbon nanotubes in the carbon nanotube film are selected from a group consisting of single-walled carbon nanotubes, double-walled carbon nanotubes, and multi-walled carbon nanotubes. Diameters of the single-walled carbon nanotubes approximately range from 0.5 to 10 nanometers. Diameters of the double-walled carbon nanotubes approximately range from 1 to 50 nanometers. Diameters of the multi-walled carbon nanotubes approximately range from 1.5 to 50 nanometers. Since the carbon nanotube film has a high surface-area-to-volume ratio, the carbon nanotube film may easily adhere to other objects. Thus, the carbon nanotube film can directly be fixed on the first electrode 14 and second electrode 16 without the use of adhesives, because of the adhesion properties of the nanotubes. The thermionic emitter 18 made by the carbon nanotubes can also be fixed on the first electrode 14 and second electrode 16 via an adhesive, glue or conductive paste.

Figure 4:
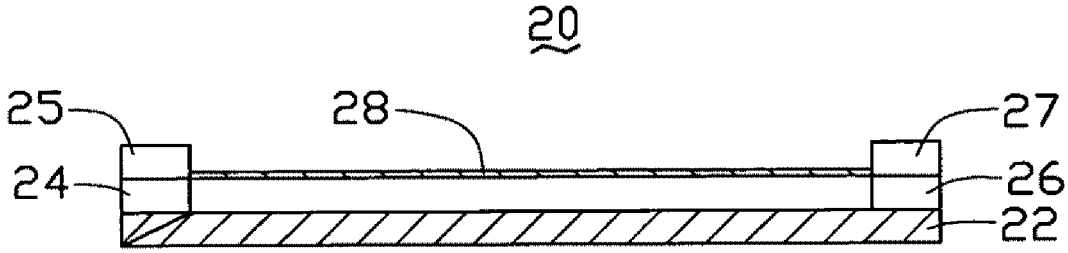
FIG. 4 is an exploded, isometric view of a thermionic electron source in accordance with a second embodiment.
Figure 5:
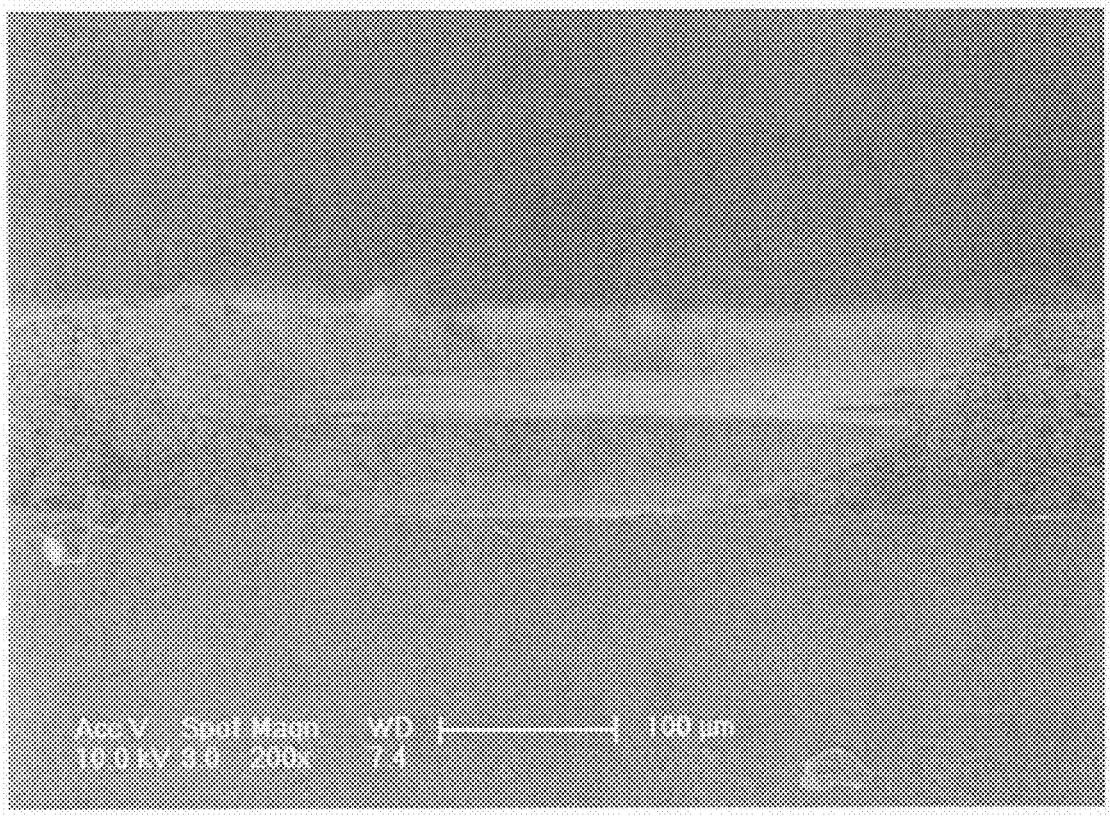
FIG. 5 shows a Scanning Electron Microscope (SEM) image of a thermionic electron source in accordance with a second embodiment.

Referring to FIG. 4 and FIG. 5, a thermionic electron source 20, in accordance with a second embodiment, includes a substrate 22, a first electrode 24, a second electrode 26, a first fixing element 25, a second fixing element 27, and a thermionic emitter 28. The first electrode 24 and second electrode 26 are separately placed on a surface of a substrate 22. The first fixing element 25 and the second fixing element 27 are placed corresponding to the first electrode 24 and the second electrode 26. The thermionic emitter 28 is secured to the first electrode 24 and the second electrode 26 by the first fixing element 25 and the second fixing element 27, respectively. The thermionic emitter 28 is fixed between the first electrode 24, the second electrode 26, and the first fixing element 25, the second fixing element 27, respectively. The thermionic emitter 28 is electrically connected to the first electrode 24 and second electrode 26. The thermionic emitter 28 is suspended above the substrate 22 by the first electrode 24 and second electrode 26. The thermionic emitter 28 of this embodiment, being the same as the thermionic emitter 18 in the first embodiment, has a film structure.

The first fixing element 25 and the second fixing element 27 are used to firmly fix the thermionic emitter 28 on the first electrode 24 and second electrode 26, respectively. The first fixing element 25 and the second fixing element 27 fix the thermionic emitter 28 on the first electrode 24 and second electrode 26, respectively, via conductive glue. The method for fixing the thermionic emitter 28 on the first electrode 24 and second electrode 26, respectively, is not limited to the present method. In the present embodiment, the first fixing element 25 and the second fixing element 27 is a silver paste. Either of the first fixing element 25 and the second fixing element 27 can be used to fix the thermionic emitter 28 on the first electrode 24 and second electrode 26.

Figure 6:
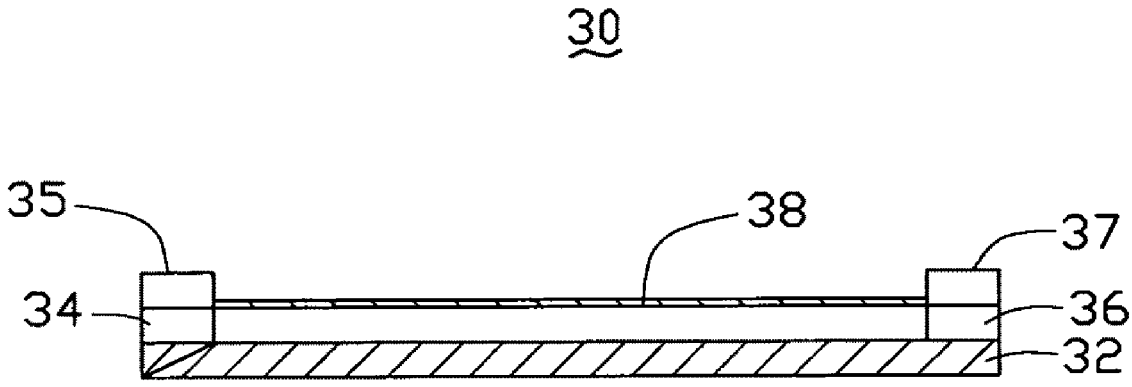
FIG. 6 is an exploded, isometric view of a thermionic electron source in accordance with a third embodiment.

Referring to FIG. 6, a thermionic electron source 30, in accordance with a third embodiment, includes a substrate 32, a first supporting element 34, a second supporting element 36, a first electrode 35, a second electrode 37, and a thermionic emitter 38. The first supporting element 34 and the second supporting element 36 are separately located on a surface of the substrate 32. The first electrode 35 and second electrode 37 are located corresponding to the first supporting element 34 and the second supporting element 36. The thermionic emitter 38 is located between the first electrode 35, the second electrode 37, and the first supporting element 34, the second supporting element 36, respectively. The thermionic emitter 38 is suspended above the substrate 32 by the first supporting element 34 and the second supporting element 36. The first electrode 35 and second electrode 37 are separately located on a surface of the thermionic emitter 38 and electrically connected thereto. The first electrode 35 and second electrode 37 are fixed on the surface of the thermionic emitter 38 by a conductive adhesive. In this embodiment, the thermionic emitter 38, being the same as the thermionic emitter 18 in the first embodiment, has a film structure.

The first supporting element 34 and the second supporting element 36 are used to suspend the thermionic emitter 28 above the substrate 32. The first supporting element 34 and the second supporting element 36 are fixed on the substrate 32 via conductive glue or paste. In the present embodiment, the first supporting element 34 and the second supporting element 36 are a glass layer.

Figure 7:
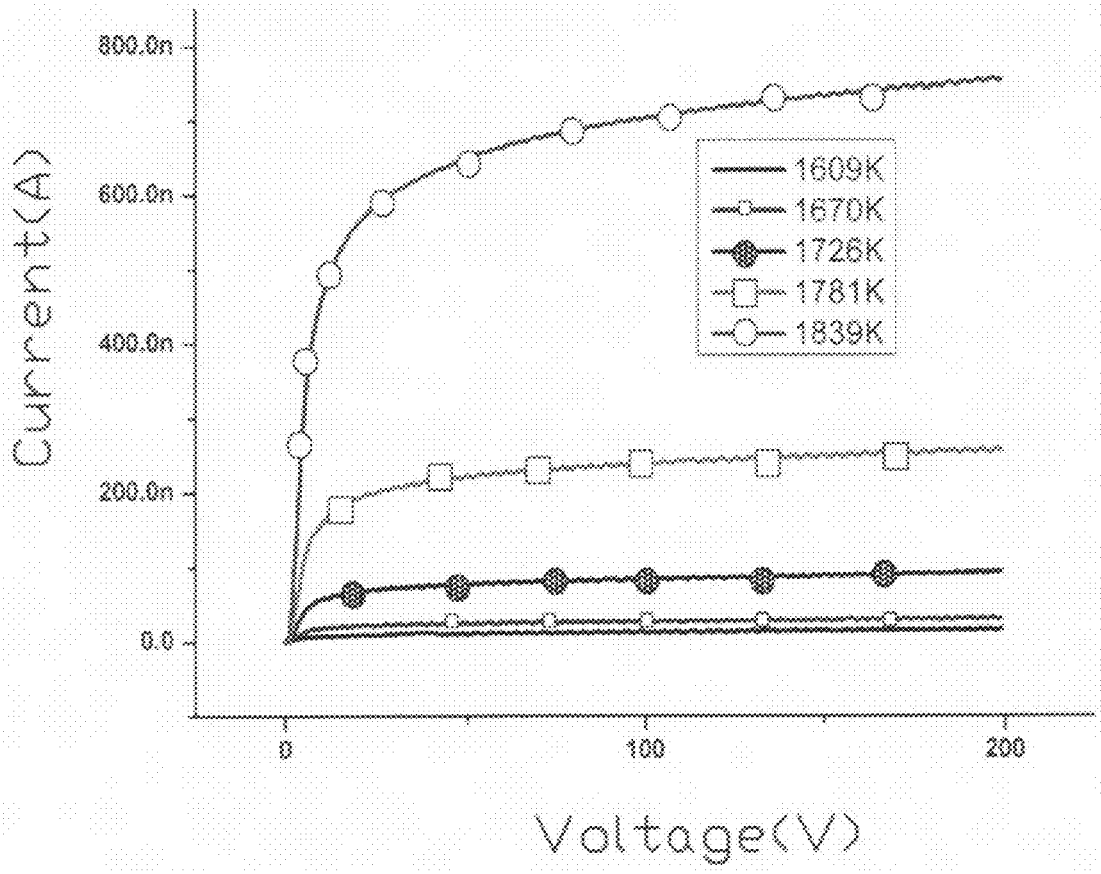
FIG. 7 is a thermal emitting characteristic curve of a thermionic electron source in accordance with a first embodiment.

During use, a voltage is applied between the first electrode 14, 24, 35 and the second electrode 16, 26, 37 to heat the carbon nanotube film. Kinetic energy of the electrons in the carbon nanotube film is increased. When the kinetic energy of the electrons therein is large enough, the electrons will emit or escape from the emitters. These electrons are thermions. In the present embodiment, a length of the first electrode 14, 24, 35 and the second electrode 16, 26, 37 is 200 micrometers, and a width thereof is 150 micrometers. The thermionic emitter 18, 28, 38 is a carbon nanotube layer and the carbon nanotube layer includes a carbon nanotube film. In the embodiments the length of the carbon nanotube film is 300 micrometers and a width thereof is 100 micrometers. FIG. 7 is a thermal emitting characteristic curve of a thermionic electron source 10 in accordance with a first embodiment. When a 3.65 V (volts) voltage is applied between the first electrode 14 and the second electrode 16, 44 milliamperes of current will flow through the carbon nanotube film. A temperature of the carbon nanotube film can reach up to 1557 K, and the carbon nanotube film can emit electrons at this temperature. When the voltage increases to 4.36 V (volts) voltages, 56 milliamperes of current will flow through the carbon nanotube film. A temperature of the carbon nanotube film can reach up to 1839 K, and the carbon nanotube film can emit uniform incandescent light. As shown in FIG. 5, the thermionic electron source 10 can emit thermions at a low power.

Compared to conventional technologies, the thermionic electron source 10, 20, 30 provided by the present embodiments has the following advantages: firstly, since the thermionic emitter adopts carbon nanotube film, and the carbon nanotubes in the carbon nanotube film are uniformly distributed, the thermionic electron source 10, 20, 30 adopting the thermionic emitter 18, 28, 38 can acquire a uniform and stable thermal electron emissions states. Secondly, since the thermionic emitter 18, 28, 38 and the substrate 12, 22, 32 are separately located, the substrate 12, 22, 32 will not transfer the energy for heating the thermionic emitter 18, 28, 38 in the process of heating, and as a result, the thermionic electron source 10, 20, 30 will have an excellent thermionic emitting property. Thirdly, since the carbon nanotube film has a small width and a low resistance, the thermionic electron source 10, 20, 30 adopting the carbon nanotube film can emit electrons at a low thermal power.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A thermionic electron source comprising:

a substrate;

two electrodes; and a thermionic emitter, the thermionic emitter being electrically connected to the two electrodes, the thermionic emitter having a film structure;

wherein a space is defined between the thermionic emitter and the substrate;

wherein the thermionic emitter comprises a carbon nanotube layer;

wherein the carbon nanotube layer comprises multiple overlapped carbon nanotube films;

wherein each of the multiple overlapped carbon nanotube films comprises a plurality of carbon nanotubes oriented along a preferred orientation and adjacent films are set at an angle between the aligned directions of the carbon nanotubes.

2. The thermionic electron source as claimed in claim 1, wherein a length of the thermionic emitter approximately ranges from 50 micrometers to 1 millimeter, and a width thereof approximately ranges from 50 micrometers to 500 micrometers.

3. The thermionic electron source as claimed in claim 1, wherein a width of each of the multiple overlapped carbon nanotube films approximately ranges from 0.01 centimeters to 10 centimeters, and a thickness thereof approximately ranges from 10 nanometers to 100 micrometers.

4. The thermionic electron source as claimed in claim 1, wherein each of the multiple overlapped carbon nanotube films comprises a plurality of successive and alike oriented carbon nanotube segments joined end-to-end by van der Waals attractive force therebetween.

5. The thermionic electron source as claimed in claim 4, wherein the carbon nanotube segments comprise a plurality of carbon nanotubes parallel with each other, and the adjacent carbon nanotubes are adhered by van der Waals attractive force therebetween.

6. The thermionic electron source as claimed in claim 1, further comprising a low-work-function layer located on a surface of the thermionic emitter.

7. The thermionic electron source as claimed in claim 6, wherein a material of the low-work-function layer is selected from the group consisting of barium oxide and thorium oxide.

8. The thermionic electron source as claimed in claim 1, wherein the two electrodes are located on a surface of the substrate, and the thermionic emitter is suspended above the substrate by the two electrodes.

9. The thermionic electron source as claimed in claim 1, wherein the thermionic emitter is fixed on the two electrodes by a glue or conductive paste.

10. The thermionic electron source as claimed in claim 1, further comprising two fixing elements; the thermionic emitter is secured to the two electrodes by the fixing elements; and the electrodes are located on the substrate.

11. The thermionic electron source as claimed in claim 1, further comprising two or more supporting elements located on the substrate, and the thermionic emitter being suspended above the substrate by the supporting elements.

12. The thermionic electron source as claimed in claim 11, wherein the two electrodes are fixed on the thermionic emitter by a conductive glue or paste.

13. The thermionic electron source as claimed in claim 1, wherein the thermionic emitter is flat.

14. The thermionic electron source as claimed in claim 13, wherein the thermionic emitter is substantially parallel to the substrate.

* * * * *